US007819694B2

(12) United States Patent
Miyashita et al.

(10) Patent No.: US 7,819,694 B2
(45) Date of Patent: Oct. 26, 2010

(54) ELECTRICAL CONNECTOR

(75) Inventors: Takashi Miyashita, Tokyo (JP); Kazuhiko Furukatsu, Tokyo (JP); Yoshihisa Kashimoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/310,705

(22) PCT Filed: Sep. 4, 2007

(86) PCT No.: PCT/JP2007/067163

§ 371 (c)(1),
(2), (4) Date: Mar. 3, 2009

(87) PCT Pub. No.: WO2008/029780

PCT Pub. Date: Mar. 13, 2008

(65) Prior Publication Data

US 2010/0022126 A1 Jan. 28, 2010

(30) Foreign Application Priority Data

Sep. 4, 2006 (JP) ..... 2006-238831

(51) Int. Cl.
*H01R 9/05* (2006.01)

(52) U.S. Cl. ..... 439/585; 439/578

(58) Field of Classification Search ..... 439/578, 439/585

See application file for complete search history.

(56) References Cited

U.S. PATENT DOCUMENTS

| | | | | |
|---|---|---|---|---|
| 4,070,751 | A * | 1/1978 | Hogendobler et al. | 29/882 |
| 4,990,104 | A * | 2/1991 | Schieferly | 439/578 |
| 4,990,105 | A * | 2/1991 | Karlovich | 439/578 |
| 5,041,021 | A | 8/1991 | Sato | |
| 6,558,194 | B2 * | 5/2003 | Montena | 439/585 |
| 7,048,579 | B2 * | 5/2006 | Montena | 439/578 |
| 2007/0093127 | A1 * | 4/2007 | Thomas et al. | 439/578 |
| 2007/0190854 | A1 * | 8/2007 | Harwath | 439/578 |

FOREIGN PATENT DOCUMENTS

| | | |
|---|---|---|
| JP | 23912/1980 | 9/1981 |
| JP | 148780/1988 | 5/1990 |
| JP | 03-033981 | 4/1991 |
| JP | 142069/1989 | 8/1991 |
| JP | 9-283232 | 10/1997 |
| JP | 2006-32029 | 2/2006 |

OTHER PUBLICATIONS

International Search Report.
Chinese Office Action.

* cited by examiner

*Primary Examiner*—Gary F. Paumen
(74) *Attorney, Agent, or Firm*—Collard & Roe, P.C.

(57) ABSTRACT

A connector to be connected to a cable 41 includes an outer conductor having a first cylindrical portion 33 and a second cylindrical portion 35 connected to each other. The first cylindrical portion holds a conductive contact 11. The second cylindrical portion has a guide portion 35*a*. A cable inserted into the second cylindrical portion is decentered by the guide portion in a predetermined direction in a predetermined radial direction.

13 Claims, 5 Drawing Sheets

ELECTRICAL CONNECTOR

CROSS REFERENCE TO RELATED APPLICATIONS

This application is the National Stage of PCT/JP2007/067163 filed on Sep. 4, 2007, which claims priority under 35 U.S.C. §119 of Japanese Application No. 2006-238831 filed on Sep. 4, 2006. The international application under PCT article 21(2) was not published in English.

TECHNICAL FIELD

This invention relates to a connector to be connected to a cable.

BACKGROUND ART

Japanese Unexamined Patent Application Publication (JP-A) No. H9-283232 (related art 1) discloses an output connector in which an outer conductor serving as a ground terminal of the output connector is formed on a casing and a projection is formed inside a hook formed at a tip of an insulating resin with a connector pin fitted thereto. When the insulating resin is fitted into the outer conductor, a tip of the center connector pin is pushed up by the projection to be connected to an output terminal of a circuit board.

Japanese Unexamined Utility Model Application Publication (JP-U) No. H2-69484 (related art 2) discloses a coaxial connector having a center conductor connecting member to be press-crimped and connected to a tip of a center conductor of a coaxial cord. Two openings opposite to each other are formed on a cylindrical surface of an outer conductor connecting member at a position where the center conductor is press-crimped. The coaxial connector uses a caulking tube which is externally contacted with the outer conductor connecting portion and which has a tube length extended so as to close the openings.

Japanese Unexamined Patent Application Publication (JP-A) No. 2006-32029 (related art 3) discloses a sleeve for connecting a connector, in which a hole opening plane at a tip end of a cylindrical part is inclined with respect to a plane perpendicular to a cylindrical axis. An inclined surface is formed from a peripheral line of an opening towards an outer surface of the cylindrical part preceding it to form a blade-shaped part having a sharp end. The sleeve is fitted in the manner such that the cylindrical part is inserted between a copper foil tape and a shielded wire of a coaxial cable with the blade-shaped part directed frontward.

Patent Document 1: Japanese Unexamined Patent Application Publication (JP-A) No. H9-283232

Patent Document 2: Japanese Unexamined Utility Model Application Publication (JP-U) No. H2-69484

Patent Document 3: Japanese Unexamined Patent Application Publication (JP-A) No. 2006-32029

DISCLOSURE OF THE INVENTION

Problem to be Solved by the Invention

In the related art 1, when the insulating resin is fitted into the outer conductor, the tip of the center connector pin is pushed up by the projection to be connected to the output terminal of the circuit board. With this structure, two components including the casing and the insulating resin are required. Thus, there is a problem that the number of components is increased and assembling is complicated.

In the related art 2, in case where the tip of the center conductor of the coaxial cord and the center conductor connecting member are connected to each other by solder, one opening may be sufficient. However, there is a problem that, for the purpose of closing the one opening, the caulking tube extended in tube length is required.

In the related art 3, the sharp blade-shaped part of the sleeve may possibly deform the copper foil tape or the shielded wire. Consequently, there is a problem that troublesome work is required to correct the deformation of the copper foil tape or the shielded wire and to thereafter mount the same to the coaxial cable again.

It is therefore an exemplary object of the present invention to provide a connector which is capable of reliably positioning a core wire and a terminal portion at predetermined positions and which can be reduced in number of components.

Further, it is another exemplary object of the present invention to provide a connector which can be connected by both of press-crimping connection and soldering connection.

Means to Solve the Problem

According to an exemplary aspect of the present invention, there is provided a connector to be connected to a cable, comprising a cylindrical body which comprises a first cylindrical portion and a second cylindrical portion which is connected to the first cylindrical portion and is insertable with the cable inserted therein, and a conductive contact which is held by the first cylindrical portion and to be connected to the cable that is inserted into the second cylindrical portion, wherein the second cylindrical portion comprises a guide portion for decentering the cable towards a predetermined direction in a predetermined radial direction.

The contact may comprise a terminal portion which has a generally U-shape in section in a direction perpendicular to a cylindrical axis of the first cylindrical portion and is capable of receiving a part of the cable. The generally U shape may be opened in the predetermined direction.

The connector may comprise a block which holds the contact in the first cylindrical portion.

The cylindrical body may be conductive and the block may have insulation properties.

The contact may comprise a holding portion which is held by the block; a terminal portion which extends from the holding portion toward the second cylindrical portion to protrude from the block and to be connected to the cable; and a contact portion which extends from the holding portion toward a side opposite to the terminal portion to protrude from the block.

The terminal portion may comprise a bottom portion which is connected to the holding portion and is parallel to a cylindrical axis of the first cylindrical portion; and a pair of crimping portions which extend from the bottom portion so as to face to each other with the cylindrical axis being placed therebetween.

The second cylindrical portion may have a diameter smaller than that of the first cylindrical portion. The cylindrical body may comprise a third cylindrical portion which is taper-shaped and connects the first cylindrical portion and the second cylindrical portion together. The first cylindrical portion, the second cylindrical portion, and the third cylindrical portion may be positioned on a common central axis.

The first cylindrical portion may comprise opening portions which are opposite to each other in the predetermined radial direction.

The guide portion may be formed by cutting and inward raising a part of the second cylindrical portion.

The guide portion may be formed by inward extruding a part of the second cylindrical portion.

The guide portion may protrude from an inner surface of the second cylindrical portion in the predetermined direction.

The second cylindrical portion may have an insertion opening for inserting the cable, and the insertion opening may have a portion inclined with respect to a cylindrical axis.

The second cylindrical portion may have an insertion opening for inserting the cable, and the insertion opening may have a first portion which is inclined toward one side with respect to a cylindrical axis and a second portion which is inclined toward the other side with respect to the cylindrical axis.

EFFECT OF THE INVENTION

According to the connector of the exemplary aspect of the present invention, the core wire and the terminal portion can reliably be positioned at predetermined positions and the number of components can be reduced. Further, the connector can be connected by both of press-crimping connection and soldering connection.

BEST MODE FOR EMBODYING THE INVENTION

Figure 1:
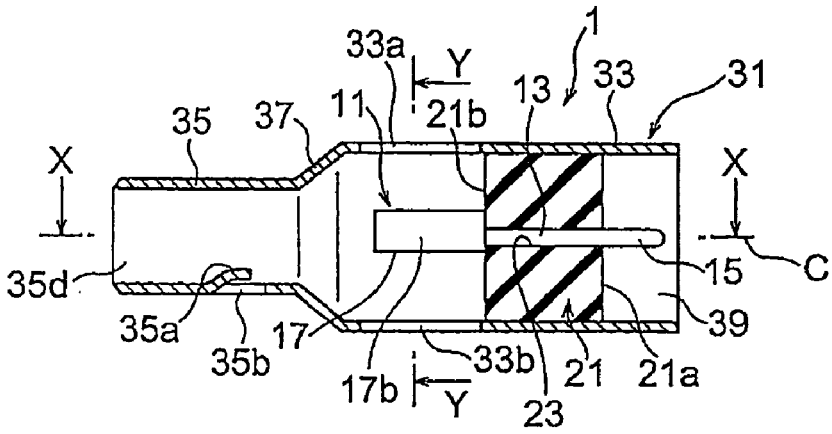
FIG. 1 is a side sectional view of a connector according to an exemplary embodiment of the present invention.
Figure 2:
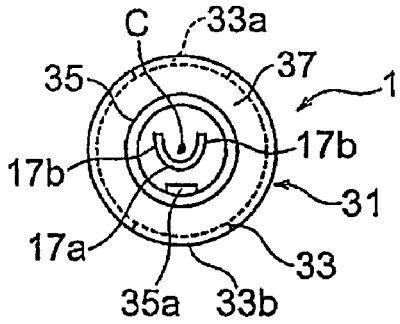
FIG. 2 is a front view of the connector in FIG. 1, as seen from the left side.
Figure 3:
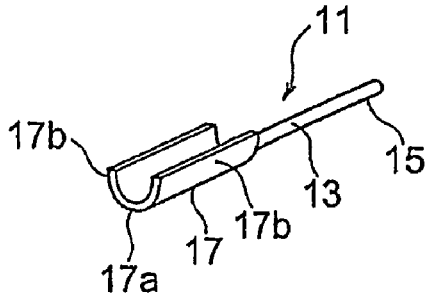
FIG. 3 is a perspective view showing a contact of the connector in FIG. 1.

Referring to FIGS. 1 to 3, a structure of a connector according to an exemplary embodiment of the present invention will be described.

The connector 1 comprises a conductive contact 11, an insulating block 21 holding the contact 11, and a cylindrical outer conductor 31 comprising a conductive cylindrical body and holding the block 21 so as to cover the contact 11 and the block 21.

The contact 11 has a holding portion 13 extending on a central axis C of the connector 1 and held by the block 21, a contact portion 15 extending from one end of the holding portion 13 on the central axis C, and a terminal portion 17 coupled to the other end of the holding portion 13.

The terminal portion 17 has a generally semi-cylindrical shape as a whole and has a bottom portion 17*a* extending from the holding portion 13 in parallel with the central axis C, and a pair of crimping portions 17*b* and 17*b* extending from the bottom portion 17*a* so as to face each other with the central axis C interposed inside. Therefore, in a section intersecting with the central axis C, the terminal portion 17 has a generally U-shaped section which is open on one side in a predetermined radial direction, i.e., which is open in a predetermined direction in a radial direction. The central axis C is positioned inside a portion of the generally-U-shaped section. Such a terminal portion 17 is generally called a barrel. The contact 11 may be made by punching out a thin conductive plate into an exploded shape of the contact 11 and thereafter carrying out a bending work.

The block 21 is made of a resin material and has a cylindrical shape. The block 21 has a holding hole 23 penetrating therethrough along the central axis C. Through the holding hole 23, the holding portion 13 of the contact 11 is inserted and held therein.

From one side surface 21*a* of the block 21 which intersects with the central axis C, the contact portion 15 of the contact 11 protrudes along the central axis C to the outside. From the other side surface 21*b* of the block 21 which is opposite to the one side surface 21*a*, the terminal portion 17 of the contact 11 extends along the central axis C.

The outer conductor 31 has a first cylindrical portion 33 holding the block 21, a second cylindrical portion 35 having a diameter smaller than that of the first cylindrical portion 33, and a taper-shaped third cylindrical portion 37 connecting the first and the second cylindrical portions 33 and 35 in an axial direction along the central axis C.

Each of the first through the third cylindrical portions 33, 35, and 37 has a cylindrical axis which is positioned on the central axis C. Inside the first cylindrical portion 33, the block 21 is held in a middle area in the axial direction. The first cylindrical portion 33 has one side portion which serves as a fitting portion 39 into which a mating connector not shown in the figure is fitted. Inside the fitting portion 39, the contact portion 15 is positioned with a space kept from the first cylindrical portion 33. When the mating connector is fitted to the fitting portion 39, the mating connector is brought into contact with the contact portion 15 and the fitting portion 39.

Further, inside the first cylindrical portion 33, the terminal portion 17 extending from the other side surface 21*b* of the block 21 towards the third cylindrical portion 37 is positioned with a space kept from the first cylindrical portion 33. The terminal portion 17 extends from the other side surface 21*b* of the block 21 along the central axis C.

The other side portion of the first cylindrical portion 33 is provided with a first opening portion 33*a* formed on an upper wall in the radial direction perpendicular to the central axis C and a second opening portion 33*b* formed on a lower wall in the radial direction. The first opening portion 33*a* is positioned so that an end of the terminal portion 17 and an inner surface of the portion of the U-shaped section are seen therethrough. The second opening portion 33*b* is positioned so that an outer surface of the bottom portion 17*a* of the terminal portion 17 and an outer surface of the portion of the U-shaped section are seen therethrough.

The second cylindrical portion 35 is provided with a guide portion 35*a* formed at a position corresponding to the second opening portion 33*b* in a circumferential direction. The guide portion 35*a* is formed by cutting and inward raising a part of a wall on the other side of the second cylindrical portion 35 in the above-mentioned predetermined radial direction. Therefore, the guide portion 35*a* protrudes inside the second cylindrical portion 35 and toward the one side in the predetermined radial direction. Further, as a result of forming the guide portion 35*a*, a cutout hole 35*b* is formed.

Figure 4:
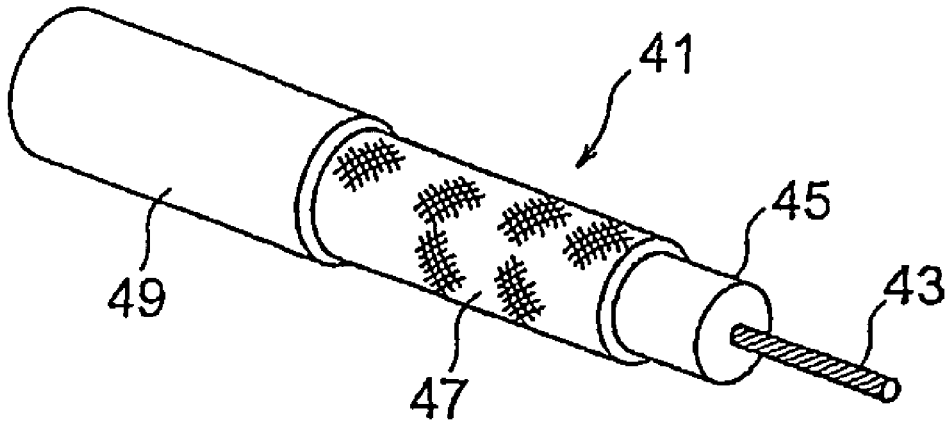
FIG. 4 is a perspective view showing one end side of a coaxial cable to be connected to the connector in FIG. 1.
Figure 5:
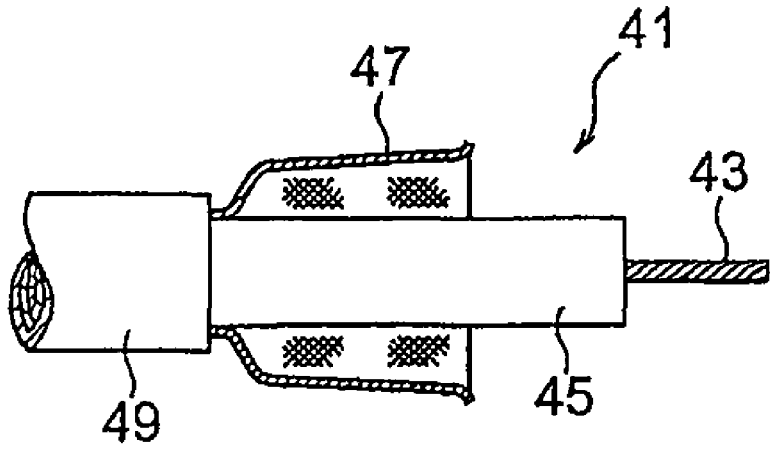
FIG. 5 is a side view showing a state before the one end side of the coaxial cable in FIG. 4 is connected to the connector, with only a shielded wire shown in section.

Referring to FIGS. 4 and 5 in addition, a coaxial cable 41 to be inserted into and connected to the connector 1 will be described.

The coaxial cable 41 in FIG. 4 comprises a core wire 43 formed by twisting thin metallic wires, such as copper, an insulator 45 made of a resin material and holding the core wire 43, a shielded wire 47 formed by braiding thin metallic wires, such as copper, and covering an outer periphery of the insulator 45, and an insulating outer cover 49 made of a resin material and covering the shielded wire 47.

Before the coaxial cable 41 is connected to the connector 1, each of the core wire 43, the insulator 45, and the shielded wire 47 is partly exposed at one end portion of the coaxial cable 41, which is to be connected to the connector 1. Further, as shown in FIG. 5, the shielded wire 47 is expanded so as to be separated from the insulator 45.

It is noted here that the second cylindrical portion 35 of the outer conductor 31 has an inner diameter set to be slightly greater than a diameter of the insulator 45 of the coaxial cable 41. Thus, the inner diameter of the second cylindrical portion 35 being slightly greater than the diameter of the insulator 45 makes it easy to smoothly insert the insulator 45 into the second cylindrical portion 35.

Figure 6:
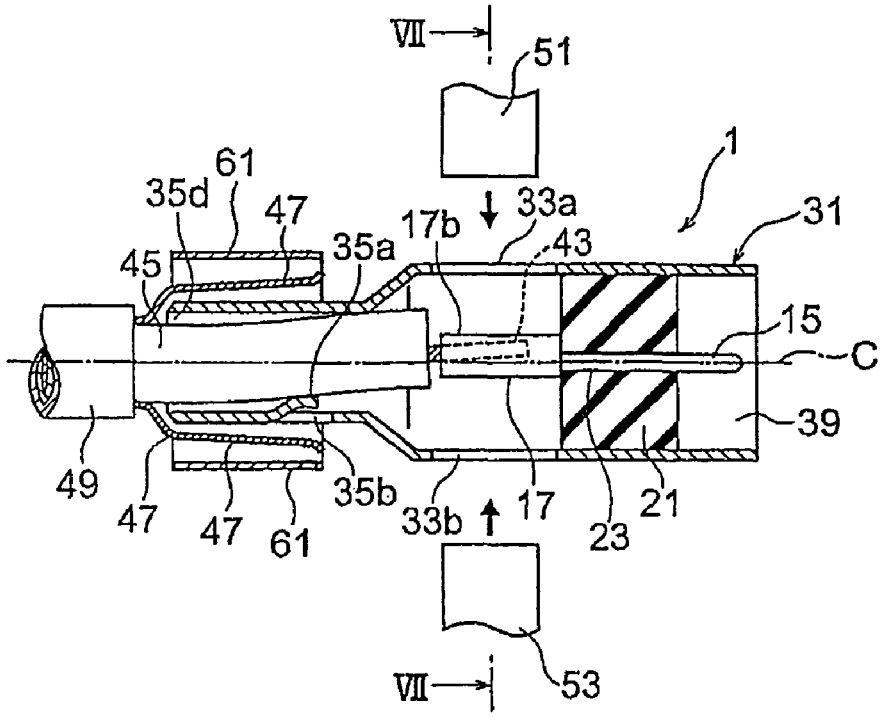
FIG. 6 is a side sectional view showing, together with a press-crimping jig, an intermediate state where the coaxial cable in FIG. 5 is connected to the connector in FIG. 1 by using a holding member.
Figure 7:
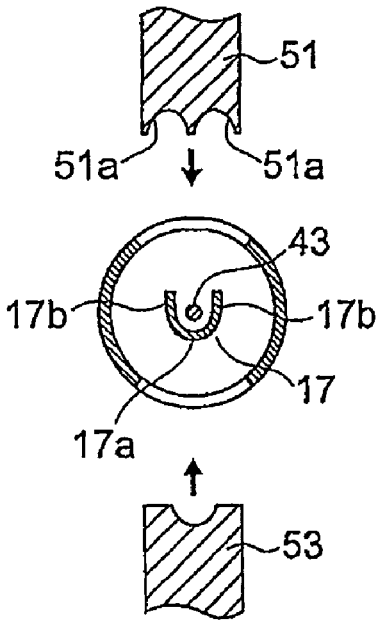
FIG. 7 is a sectional view taken along a line VII-VII in FIG. 6.
Figure 8:
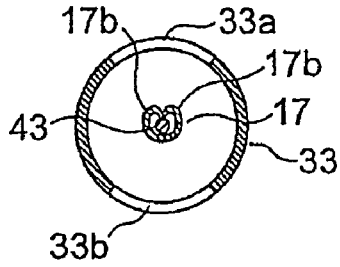
FIG. 8 is a sectional view similar to FIG. 7, showing a state after the coaxial cable in FIG. 5 is connected to the connector in FIG. 1.

Referring also to FIGS. 6 through 8, one example of a structure for connecting the coaxial cable 41 to the connector 1 will be described.

In the second cylindrical portion 35 of the connector 1, the one end portion of the coaxial cable 41 is inserted into an insertion opening 35*d* of the second cylindrical portion 35 shown in FIG. 1, with the core wire 43 of the coaxial cable 41 shown in FIG. 5 directed forward. In an initial state of insertion into the second cylindrical portion 35, the coaxial cable 41 is inserted in the axial direction because the insulator 45 does not yet reach the guide portion 35*a*.

When the coaxial cable 41 is further inserted into the second cylindrical portion 35, a part of an outer peripheral surface of the insulator 45 of the coaxial cable 41 is pushed by the guide portion 35*a* and slides. In this event, as shown in FIG. 6, the insulator 45 is bent toward the first opening portion 33*a* and inserted with inclination toward a position deviated from the central axis C. Consequently, the core wire 43 is also inserted with inclination toward the first opening portion 33*a*.

Therefore, when the core wire 43 of the coaxial cable 41 is inserted into the first cylindrical portion 33 and the insertion is completed at a predetermined position, the core wire 43 can be easily positioned within the terminal portion 17 of the generally U-shaped section, specifically, at an upper position as a predetermined position between the pair of crimping portions 17*b* and 17*b* and inside the bottom portion 17*a*.

Upon the insertion of the core wire 43 and the insulator 45, the guide portion 35*a* serves to prevent the core wire 43 from colliding with an end face of the terminal portion 17 or from being positioned outside the terminal portion 17 without being positioned within a predetermined area between the crimping portions 17*b* and 17*b*.

Further, the guide portion 35*a* is provided because it is difficult to accurately manufacture the second cylindrical portion 35 having a diameter in conformity with that of the insulator 45. By forming the guide portion 35*a* on the second cylindrical portion 35, the insulator 45 is positioned by the guide portion 35*a*.

After the core wire 43 of the coaxial cable 41 is positioned at the terminal portion 17, a crimper 51 which is a known crimping tool is lowered through the first opening portion 33*a* and an anvil 53 is raised through the second opening portion 33*b* to be brought into contact with the terminal portion 17, as shown in FIGS. 6 and 7. Thereafter, by arch portions 51*a* of the crimper 51, the crimping portions 17*b* are rounded inward to press-crimp the terminal portion 17 to the core wire 43, as shown in FIG. 8. Thus, the coaxial cable 41 is connected to the connector 1.

After the core wire 43 of the coaxial cable 41 is connected to the terminal portion 17, the guide portion 35*a* is deformed by a special jig (not shown in the figure) through the cutout hole 35*b* to press the insulator 45. Thus, the guide portion 35*a* can be used as holding means for holding the insulator 45.

Further, upon the insertion of the core wire 43 and the insulator 45 of the coaxial cable 41 into the second cylindrical portion 35, the shielded wire 47 is positioned outside the second cylindrical portion 35. The shielded wire 47 is covered with a holding member 61 having a split sleeve shape and the holding member 61 is tightened by a caulking jig (not shown in the figure) to be externally pressed. As a result, the shielded wire 47 and the outer conductor 31 are pressed to each other to achieve ground connection.

Incidentally, the insulator 45 of the coaxial cable 41 can be held by the holding member 61 also. Therefore, instead of forming the guide portion 35*a* and the cutout hole 35*b* by cutting and raising the wall of the second cylindrical portion 35, the guide portion 35*a* may be protruded by extruding the wall of the second cylindrical portion 35 into a convex shape from an outer surface to an inner surface. In this event, a ring-shaped holding member may be mounted on the shielded wire 47.

Alternatively, after the core wire 43 of the coaxial cable 41 is positioned at the terminal portion 17, solder may be poured through the first opening portion 33*a* by using a soldering jig to thereby connect the core wire 43 and the terminal portion 17 by soldering. In case of connection by soldering, it is not necessary to form the second opening portion 33*b* of the outer conductor 31.

Furthermore, in such a structure in which the core wire 43 and the terminal portion 17 are soldered to each other, the terminal portion 17 may have a shape comprising only the bottom portion 17*a* without the crimping portions 17*b* and 17*b*. Even in case where the bottom portion 17*a* is a flat plate, the core wire 43 can reliably be positioned on the flat plate by the guide portion 35*a*. Accordingly, soldering can easily be carried out.

Figure 9:
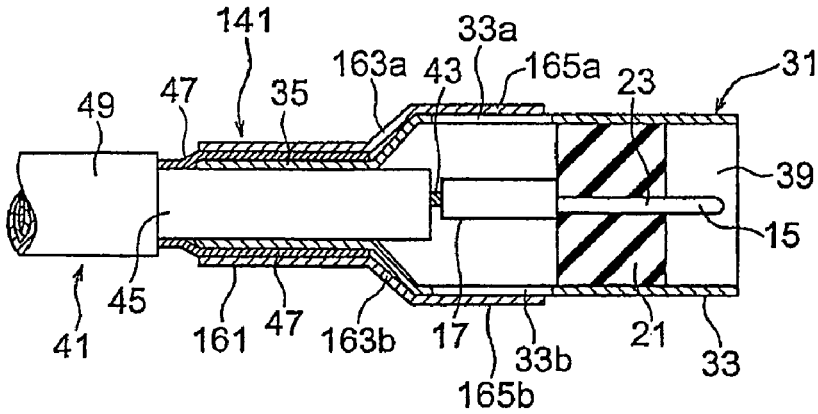
FIG. 9 is a side sectional view showing a state after the coaxial cable in FIG. 5 is connected to the connector in FIG. 1 by using another holding member.
Figure 10:
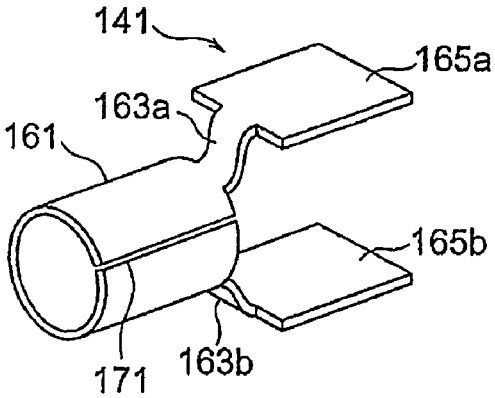
FIG. 10 is a perspective view showing a crimping component used in FIG. 9.

Referring to FIGS. 9 and 10, another example of a structure for connecting the coaxial cable 41 to the connector 1 will be described. Since the connector 1 and the coaxial cable 41 shown in FIG. 9 are the same as the connector 1 and the coaxial cable 41 described in connection with FIGS. 1 through 8, description thereof will be omitted.

In FIGS. 9 and 10, a holding member 141 has a caulking portion 161 having a slotted sleeve shape and a pair of flat-plate-shaped shielding portions 165*a* and 165*b* connected to one end of the caulking portion 161 through a pair of connecting portions 163*a* and 163*b*, respectively. The caulking portion 161 is provided with a slit 171. The caulking portion 161 may have a shape same as that of the holding member 61 shown in FIG. 6 and tightens and holds the shielded wire 47 on the second cylindrical portion 35.

After the core wire 43 of the coaxial cable 41 and the crimping portion 17 of the contact 11 are wired and connected to each other, the one shielding portion 165*a* shields the first opening portion 33*a*. Simultaneously, the other shielding portion 165*b* shields the second opening portion 33*b*.

In case where the terminal portion 17 and the core wire 43 are connected to each other by soldering as mentioned above, the second opening portion 33*b* is not required. In this case, the holding member 141 having only the one shielding portion 165*a* is used. Without being limited to the flat plate shape, the pair of shielding portions 165*a* and 165*b* may be an arc-shaped plate along a circumferential surface of the first cylindrical portion 33. The holding member 141 may be made by punching out a thin conductive plate into an exploded shape of the holding member 141 and thereafter carrying out a bending work.

Figure 11:
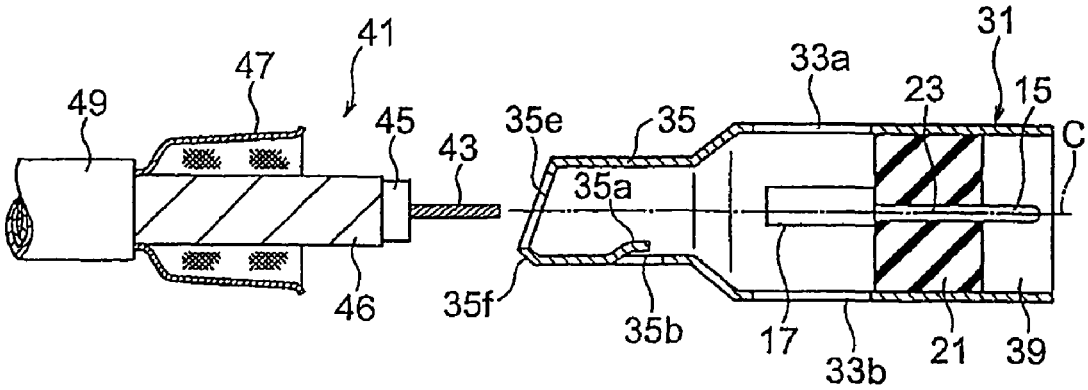
FIG. 11 is a sectional view showing an intermediate state where the coaxial cable in FIG. 5 is going to be connected to a connector according to another exemplary embodiment of the present invention.
Figure 12:
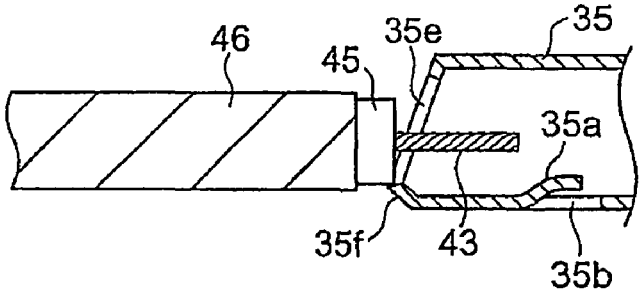
FIG. 12 is an enlarged sectional view showing the intermediate state where an operation of connecting the coaxial cable in FIG. 5 to the connector in FIG. 11 progresses.

Referring to FIGS. 11 and 12, a connector according to another exemplary embodiment of the present invention will be described. Similar parts are designated by the same reference numerals and description thereof will be omitted.

A coaxial cable 41 is same in structure as the coaxial cable 41 shown in FIGS. 4 and 5 except that a shield tape 46, such as a copper tape, is wound around an outer circumferential surface of an insulator 45.

A second cylindrical portion 35 of the connector 11 has an insertion opening 35*e* formed at its end. The insertion opening is inclined to one side with respect to a central axis C so that a lower portion provided with a guide portion 35*a* protrudes forward from an upper portion. The insertion opening 35*e* has an inclined portion 35*f* formed at the lower part thereof and inclined to an opposite side.

The insertion opening 35*e* at the end of the second cylindrical portion 35 is inclined. Therefore, when the insulator 45 with the shield tape 46 wound thereon is inserted into the second cylindrical portion 35, one point of the shield tape 46 is first guided into the insertion opening 35*e* adjacent to the inclined portion 35*f* at the lower part of the insertion opening 35*e*. Thereafter, a part of the shield tape 46 is gradually guided and inserted into the second cylindrical portion.

Therefore, upon insertion into the insertion opening 35*e*, deformation of the shield tape 46 is prevented.

According to the connector mentioned above, the outer conductor is provided with the guide portion for guiding the core wire of the cable toward the terminal portion of the contact and positioning the core wire. Therefore, when the core wire is guided to a predetermined position of the terminal portion so as to wire the core wire and the terminal portion to each other, the core wire can be prevented from being deviated from the terminal portion.

Further, since the outer conductor is provided with the guide portion for guiding the core wire of the cable toward the terminal portion of the contact and positioning the core wire, the cable can be held inside the outer conductor by pressing the insulator of the cable by the guide portion when the core wire and the terminal portion are wired and connected to each other. Hence, one end portion of the cable can reliably be held by the outer conductor.

Furthermore, since the outer conductor is provided with the guide portion for guiding the core wire of the cable toward the terminal portion of the contact and positioning the core wire, it is not necessary to have a structure in which a housing is divided into two parts. Thus, the number of components can be reduced.

Further, since the outer conductor is provided with the guide portion for guiding and positioning, the core wire can be guided to a predetermined position of the terminal portion so as to wire the core wire and the terminal portion to each other. Consequently, upon wiring the core wire and the terminal portion to each other, it is possible to wire the core wire and the terminal portion to each other by press-crimping or to connect the terminal portion and the core wire to each other by soldering.

This application claims priority based on Japanese Patent Application No. 238831 filed on Sep. 4, 2006, the disclosure of which is incorporated herein in its entirety.

INDUSTRIAL APPLICABILITY

The present invention is applicable to a use as a connector for connecting a cable having a core wire held by an insulator, not being limited to a coaxial cable, and as a high-frequency connector for transmitting a high-frequency electric signal by a plurality of coaxial cables.

The invention claimed is:

1. A connector to be connected to a cable, comprising:

a cylindrical body which comprises a first cylindrical portion and a second cylindrical portion which is connected to the first cylindrical portion and is insertable with the cable therein; and a conductive contact which is held by the first cylindrical portion and to be connected to the cable that is inserted into the second cylindrical portion;

wherein the second cylindrical portion is provided with a guide portion for decentering the cable against the second cylindrical portion towards a predetermined direction in a predetermined radial direction.

2. The connector according to claim 1, wherein the contact comprises a terminal portion which has a generally U-shape in section in a direction perpendicular to a cylindrical axis of the first cylindrical portion and is capable of receiving a part of the cable, wherein the generally U shape is opened in the predetermined direction.

3. The connector according to claim 1, comprising a block which holds the contact in the first cylindrical portion.

4. The connector according to claim 3, wherein the cylindrical body is conductive and the block has insulation properties.

5. The connector according to claim 3, wherein the contact comprises:

a holding portion which is held by the block;

a terminal portion which extends from the holding portion toward the second cylindrical portion to protrude from the block and to be connected to the cable; and a contact portion which extends from the holding portion toward a side opposite to the terminal portion to protrude from the block.

6. The connector according to claim 5, wherein the terminal portion comprises:

a bottom portion which is connected to the holding portion and is parallel to a cylindrical axis of the first cylindrical portion; and a pair of crimping portions which extend from the bottom portion so as to face to each other with the cylindrical axis being placed therebetween.

7. The connector according to claim 1, wherein the second cylindrical portion has a diameter smaller than that of the first cylindrical portion, wherein the cylindrical body comprises a third cylindrical portion which is taper-shaped and connects the first cylindrical portion and the second cylindrical portion together, and wherein the first cylindrical portion, the second cylindrical portion, and the third cylindrical portion are positioned on a common central axis.

8. The connector according to claim 1, wherein the first cylindrical portion comprises opening portions which are opposite to each other in the predetermined radial direction.

9. The connector according to claim 1, wherein the guide portion is formed by cutting and inward raising a part of the second cylindrical portion.

10. The connector according to claim 1, wherein the guide portion is formed by inward extruding a part of the second cylindrical portion.

11. The connector according to claim 1, wherein the guide portion is formed at a portion of a circumferential direction of the second cylindrical portion and protrudes from an inner surface of the second cylindrical portion in the predetermined direction.

12. The connector according to claim 1, wherein the second cylindrical portion has an insertion opening for inserting the cable, and the insertion opening has a portion inclined with respect to a cylindrical axis.

13. The connector according to claim 1, wherein the second cylindrical portion has an insertion opening for inserting the cable, and the insertion opening has a first portion which is inclined toward one side with respect to a cylindrical axis and a second portion which is inclined toward the other side with respect to the cylindrical axis.

* * * * *